US011135627B2

(12) United States Patent
Jansen et al.

(10) Patent No.: US 11,135,627 B2
(45) Date of Patent: Oct. 5, 2021

(54) BRUSH WITH SPONGE OR FOAM ELEMENT

(71) Applicant: KONINKLIJKE PHILIPS N.V., Eindhoven (NL)

(72) Inventors: Marjolein Yvonne Jansen, Eindhoven (NL); Tomas Van Dijk, Eindhoven (NL); Nicole Louisa De Klein, Eindhoven (NL); Ipek Akinci, Eindhoven (NL); Linda Keijzer, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/060,055

(22) PCT Filed: Dec. 15, 2016

(86) PCT No.: PCT/EP2016/081090
§ 371 (c)(1),
(2) Date: Jun. 7, 2018

(87) PCT Pub. No.: WO2017/102897
PCT Pub. Date: Jun. 22, 2017

(65) Prior Publication Data

US 2018/0361437 A1 Dec. 20, 2018

(30) Foreign Application Priority Data

Dec. 18, 2015 (EP) ..... 15201422

(51) Int. Cl.
*B08B 7/04* (2006.01)
*A46B 9/06* (2006.01)
(Continued)

(52) U.S. Cl.
CPC ..... *B08B 7/04* (2013.01); *A46B 9/005* (2013.01); *A46B 9/028* (2013.01); *A46B 9/06* (2013.01);
(Continued)

(58) Field of Classification Search
CPC ..... A46B 13/023; A46B 13/001; A46B 9/005; A46B 9/028; A46B 9/06; A46B 2200/102;
(Continued)

(56) References Cited

U.S. PATENT DOCUMENTS 2,518,765 A 8/1950 Ecker
6,170,108 B1 * 1/2001 Knight ..... A46B 13/008 15/29
(Continued)

FOREIGN PATENT DOCUMENTS

CN 2269169 Y 12/1997
CN 203042068 U * 7/2013
(Continued)

OTHER PUBLICATIONS

Long, Y.; Machine translation—CN203042068 (Year: 2013).*
(Continued)

*Primary Examiner* — Natasha N Campbell

(57) ABSTRACT

The invention provides a body care device (1) for treating a skin, the body care device (1) comprising a housing (100) and a skin treatment head (200) associated with the housing (100), wherein the housing (100) further comprises an actuator (110) configured to rotate the skin treatment head (200) about an axis (A), wherein the skin treatment head (200) comprises a first region (210) comprising a plurality of bristles (211) and a second region (220) comprising a porous flexible material (221).

19 Claims, 2 Drawing Sheets

(51) Int. Cl.

| | |
|---|---|
| ***A46B 9/00*** | (2006.01) |
| ***A46B 9/02*** | (2006.01) |
| ***A46B 13/00*** | (2006.01) |
| ***A46B 13/02*** | (2006.01) |
| ***B08B 1/00*** | (2006.01) |
| ***B08B 1/04*** | (2006.01) |
| ***B08B 7/02*** | (2006.01) |

(52) U.S. Cl.
CPC ..... *A46B 13/001* (2013.01); *A46B 13/023* (2013.01); *B08B 1/002* (2013.01); *B08B 1/04* (2013.01); *B08B 7/02* (2013.01); *A46B 13/02* (2013.01); *A46B 2200/102* (2013.01); *A46B 2200/1006* (2013.01)

(58) Field of Classification Search
CPC .... A46B 2200/106; A47K 7/02; A61H 7/005; A61H 2201/1671; A61H 2201/1692; A61H 2201/169
See application file for complete search history.

(56) References Cited

U.S. PATENT DOCUMENTS

| | | | | |
|---|---|---|---|---|
| 6,205,611 | B1 * | 3/2001 | Vigil | A46B 7/04 132/308 |
| 6,687,942 | B1 * | 2/2004 | Pember | A47K 7/03 15/104.94 |
| 2003/0084524 | A1 * | 5/2003 | Blaustein | A61C 17/34 15/22.1 |
| 2003/0143368 | A1 * | 7/2003 | Kohlruss | A47K 7/02 428/92 |
| 2004/0097967 | A1 | 5/2004 | Ignon | |
| 2004/0154112 | A1 | 8/2004 | Braun | |
| 2005/0138740 | A1 | 6/2005 | Alfano | |
| 2006/0028306 | A1 | 2/2006 | Hukuba | |
| 2006/0058714 | A1 | 3/2006 | Rhoades | |
| 2007/0180638 | A1 | 8/2007 | McKay | |
| 2008/0052849 | A1 | 3/2008 | McKay | |
| 2009/0188528 | A1 * | 7/2009 | Junkins | A46B 5/0095 134/6 |
| 2009/0255077 | A1 * | 10/2009 | Mori | A46D 1/023 15/167.1 |
| 2009/0282628 | A1 | 11/2009 | Braun | |
| 2012/0165710 | A1 | 6/2012 | Nichols | |
| 2014/0309662 | A1 * | 10/2014 | Brewer | A45D 34/042 606/131 |
| 2014/0330289 | A1 | 11/2014 | Revivo | |
| 2015/0141884 | A1 | 5/2015 | Thiebaut | |

FOREIGN PATENT DOCUMENTS

| | | | |
|---|---|---|---|
| EP | 2700330 | A1 | 2/2014 |
| EP | 2888972 | A1 | 7/2015 |
| GB | 2472064 | A | 1/2011 |
| JP | 2010246868 | | 11/2010 |
| WO | 2014009177 | A1 | 1/2014 |
| WO | WO-2014009177 | A1 * | 1/2014 |

OTHER PUBLICATIONS

Long, Y.; Derwent abstract; CN203042068 (Year: 2013).*
hittp://www.cybercheckout.co.uk/products/roma-soft-grip-sponge-brushes.html.
hittp://www.hamessstuff.co.uk/water-brush-with-sponge-3855-p.asp.

* cited by examiner

BRUSH WITH SPONGE OR FOAM ELEMENT

This application is the U.S. National Phase application under 35 U.S.C. §371 of International Application No. PCT/EP2016/081090, filed on Dec. 15, 2016, which claims the benefit of International Application No. 15201422.1 filed on Dec. 18, 2015. These applications are hereby incorporated by reference herein.

FIELD OF THE INVENTION

The invention relates to a device for treating part of a skin. The invention further relates to a skin treatment head for use in such device, as well as to a method of treating a part of the skin.

BACKGROUND OF THE INVENTION

Brushes for treating the skin are known in the art. US2006/0058714, for instance, describes an apparatus including a handle capable of manipulation by a human hand, and one or more head portions to mate to various types of treatment attachments, which may be moved over an area of skin and/or body part by a motion generator moving the head portions, and/or by a user manipulating the handle. Various suitable attachments include applicator attachments having abrasive surfaces, oxygenating attachments having pores through which oxygen may travel, brush attachments for cleaning and polishing, thermal attachments for heating and cooling, and light radiating attachments. The motion generator may move the attachments by vibrating, spinning, oscillating, or propagating sonic waves through the head portions. Thus, attachments may be attached and removed from the head portions to treating skin and/or body parts by abrasion, cleaning, polishing, lighting, or oxygenation. Moreover, during treatment an abrasive composition, a cleaning solution, and/or a polishing solution may be applied to the skin and/or body part.

GB2472064 describes a back scrub apparatus which comprises a preferably plate or disk-like washing-area support element for location on a surface of a washing area, an electrically motorised, preferably battery powered, back scrub device removably mountable on the support element, and a charger which is remote from the support element for charging the back scrub device. The back scrub device includes a base which is releasably engagable with the support element and scrubbing element which is supported for rotation by the base. A rotational axis of the scrubbing element is perpendicular or substantially perpendicular to the support element. The support element may be attached to a shower or wall surface my suction pads. Further, a plurality of scrubbers is provided for selectable mounting on the mounting element: at least one scrubber includes bristles and at least one scrubber includes sponge.

EP2700330 describes a skin treatment device for professional and private use, including a brush implement for the use with a skin treatment device, the brush implement comprising bristles of a first type and bristles of a second type, wherein the bristles of the first type are longer than the bristles of the second type and are positioned closer to the outer contour of the brush implement.

US2012/0165710 describes a handheld facial massage and micro current therapy Device. The device includes a massage feature that enables the user to provide motorized agitation to a skin-contacting attachment selected from a group of detachable elements. The detachable skin-contacting element includes bristle brushes, massage sponges, smooth and rough applicators, among others. In addition to the motorized agitation from the attachment, the device also includes the ability to apply rejuvenating micro-current therapy to the skin. Both the motorized agitation and micro-current generation are independently user-adjustable in order to achieve the optimum treatment for each individual. Versions of the device that include galvanic current application as well as ultrasonic skin stimulation are available. The device is compact and easy to use so that the non-professional user can self-treat with professional results.

US2005/0138740 describes a body brush for use in cleaning the human body, and includes two or more brush head mounting structures each fitted with a brush head. A brush head rotation mechanism is mounted to the brush housing and is drivably connected to two or more brush head mounting structures for rotating the brush heads, and a brush head axial reciprocation mechanism is mounted to the brush housing and is drivably connected to the at least two brush head mounting structures for axially reciprocating the brush heads. The Body brush includes at least two brush heads mounted on brush head mounting structures, the mounting structures in turn being connected to rotation and reciprocation mechanisms mounted to a brush housing having a handle portion. Brush heads may take many forms, such as a disk with an outward face fitted with a cluster of bristles, or a sponge, and the brush heads preferably are mounted to be removable from the mounting structure and replaceable with other brush heads having different characteristics, such as different bristle stiffness or composition.

SUMMARY OF THE INVENTION

Body care devices, such as facial cleansing devices, known from the prior art may not be able to provide a suitable cleansing of the skin. Further, during use the use of water and/or soap may be non-optimal.

Hence, it is an aspect of the invention to provide an alternative body care device, which especially further at least partly obviates one or more of the above-described drawbacks. It is yet a further aspect of the invention to provide an alternative body care device that allows a number of functionalities with a single treatment head, allowing the user to switch less between heads. It is also an aspect to provide an alternative body care device with which the use of water and/or soap can be reduced. It is yet a further aspect to provide an alternative treatment head or brush for such body care device.

In a first aspect, the invention provides a body care device for treating a skin, the body care device ("device") comprising a housing and a skin treatment head ("head") associated with the housing, wherein the housing further comprises an actuator configured to (at least partly) rotate the skin treatment head about an axis (herein also indicated as "rotation axis"), wherein the skin treatment head comprises a first region comprising a plurality of bristles and a second region comprising a porous flexible material.

With such body care device, more efficient facial cleaning or cleansing of other body parts can be executed. In one go and with good results cleansing can be done, without having to change treatments heads. Further, due to the combination of bristles and sponge, also the cleansing can be executed longer before soap (or another cleansing liquid) has to be added (again). Further, with the present device it may also be possible to cleanse the face while dripping of liquid can be minimized or even prevented. This allows a broader and more versatile application, such as in hospitals, elderly homes, but also in beauty salons, spas, etc. Yet further, for instance when using the treatment device under a shower the porous flexible material may better retain soap, thereby reducing the amount of soap needed.

The body care device may be configured as facial cleaning (also indicated as "cleansing") device. Hence, especially the body care device may be a facial cleaning device. However, the body care device may also be configured for other skin cleaning applications. For different parts of the skin, optionally a plurality of treatment heads may be provided, each especially devoted to a specific part of the skin. Alternatively or additionally, the body care device may include a control system, configured to control the actuator and to offer different treatment schemes, e.g. with different settings like rotational speed, oscillation frequency, axial vibration frequency, etc., etc.

Especially, the body care device may be a handheld device. However, the body care device may also be integrated in a robot configured for assisting or treating people, like elderly people or people in a hospital, etc. The device is especially configured for treating the skin of a human (including infants). Hence, also different treatment heads and/or different treatment schemes may also be used for different types of people, e.g. dependent upon the age. Hence, the invention also provides a kit of parts, including a body care device and one or more treatment heads, especially a plurality of different treatment heads (with the body care device especially configured for use with detachable treatment heads).

Essentially, the body care device comprises a housing and a skin treatment head associated with the housing. The skin treatment head is in general associated with the housing via an axis which is functionally coupled with the actuator. The treatment head may be associated with the housing, such as with the axis, in a permanent way or in a releasable way. In the latter option, the treatment head may be replaced when considered desirable, e.g. because of hygienic reasons, when treating a different part of the skin, or when the treatment head loses functionality (e.g. due to erosion). Hence, especially the skin treatment head is detachable associated to the housing. For instance, snap-on snap-off means, or a screw-thread connection may be applied, though other options may also be possible.

As indicated above, the housing further comprises an actuator configured to rotate the skin treatment head about an axis (A). Especially, the actuator is configured to (at least partly) rotate the treatment head (during use of the device). Especially, the rotations may be full rotations (i.e. rotation angle 360°). However, in yet other embodiments the rotations may be part rotations, and the treatment head may rotate about the axis A in an oscillatory way. In such embodiments, the rotation angle is especially at least 10°, such as at least 30°, such as in the range of 15-30°. Hence, the treatment head is especially rotatably associated with the housing. The treatment head can be rotated relative to the housing by the actuator. The phrase "configured to (at least partly) rotate the skin treatment head about an axis" may thus in embodiments refer to full rotations ("configured to rotate the skin treatment head about an axis"), i.e. rotation angles of 360°, and may in other embodiments refer to part rotations, i.e. oscillations over a rotation angle of e.g. 10-30° ("configured to at least partly rotate the skin treatment head about an axis"). In both types of embodiments, the treatment head rotates (at least partly) about an axis (of rotation). Hence, the actuator may be configured to rotate (rotation angles of)360° the skin treatment head about an axis and/or the actuator may be configured to oscillate (rotation angles <360°, especially <<360°) the skin treatment head about an axis.

In yet other embodiments, the treatment head may include different portions that may rotate with different speeds and/or different angles. Hence, the actuator may also be configured to rotate different portions of the treatment head with different rotation conditions especially selected from the range of rotation speed (including direction) and rotation angle.

However, the actuator may also be used to apply other movements to the treatment head, such as a vibrational movement, which may especially be parallel to the rotation axis. Hence, in embodiments the actuator is further configured to vibrate the skin treatment head parallel to the axis (A). The term "actuator" may also refer to a plurality of actuators. Different actuators may be configured for different movements. A non-limiting example of a similar system is described in WO2014009177A1, which is herein incorporated by reference.

Useful rotational speeds for the rotation of the treatment head (about the axis of rotation, herein also indicated as "rotational axis") may be selected from the range of up to 350 rpm, such as in the range of 50-300 rpm, like especially in the range of 120-280 rpm.

Useful frequencies for the oscillation may be selected from the range of up to 350 Hz, like in the range of 60-300 Hz, especially in the range of 90-160 Hz.

A displacement (parallel to the axis), in the case of a vibration movement, relative to a rest position may e.g. be selected from the range of up to 0.01-2 mm (in a single direction), and especially about 0.05-1 mm peak-to-peak. Frequencies for the vibration may be selected from the range of up to 350 Hz, such as selected from the range of 20-350 Hz, such as in the range of 50-300 Hz.

The skin treatment head (or "brush") comprises a first region comprising a plurality of bristles and a second region comprising a porous flexible material.

The bristles may be configured in tufts, such as at least 10 tufts, like in the range of 10-500 tufts, like in the range of 20-200 tufts. The head may comprise e.g. in the range of 10-10,000 bristles, such as at least 100 bristles. A tuft may e.g. include 2-50 bristles, like 5-25 bristles.

The porous flexible material may especially be configured as single piece or as a few pieces. Hence, the treatment head may include a plurality of second regions. In general, there will be in the range of 1-6 second regions, such as 1-3 second regions, like a single second region. A limited number of second regions appear to provide a more efficient cleansing effect. The arrangement and shape of the porous and the arrangement of the bristles may be symmetric or my be non-symmetric. Substantially any arbitrary arrangement may be chosen, though specific embodiments are further described herein, which in general have one or more types of symmetry.

The treatment head may be substantially flat, i.e. a flat surface, or may have a curved surface, such as a curvature in one dimension (like a cylindrical surface) or a curvature in two dimensions, like a spherical segment. This surface is herein also indicated as "treatment head surface". This surface may in embodiments have an area size of in the range of 1-100 $cm^2$, especially 1.5-50 $cm^2$. Further, the treatment head may in embodiments especially have a circular cross-section, with especially the rotational axis in the center of the circular cross-section.

In specific embodiments, the bristles have a bristle height (h1) relative to said treatment head surface especially selected from the range of 4-30 mm, even more especially 8-20 mm. Further, in embodiments the bristles have especially a bristle thickness selected from the range of 20-300 μm, even more especially 30-150 μm. With such bristles, the desired flexibility and strength may be obtained, desirable by the user. The height of the bristles may vary over the treatment head surface. For instance, the bristle height may be larger at the edge and smaller closer to the center (rotational axis) of the treatment head. Hence, the height of the bristles may vary along the radius from higher to lower or from lower to higher. For instance, the bristles may be configured to provide a curved brush. Especially, the bristles comprise a polyamide, such as PA 612 (known in the art).

In yet further specific embodiments, the porous flexible material has especially a density selected from the range of 2-100 kg/m$^3$, even more especially 5-50 kg/m$^3$. Yet further, in embodiments the porous flexible material especially has a compression strength at 40% at a pressure in the range of 1-15 kPa. Density and compression are determined when the porous flexible material is dry (such as a weight percentage of water of lower than 5% of the total weight of the porous flexible material). The density can be measured with methods known in the art. The compression (especially "compression load deflection" (CLD)) may especially be determined according to DIN 53577 or ISO 3386 or ASTM 3574-91.The term "porous flexible material" indicates that the material is flexible and that the material is porous. The term flexible may especially indicate that when pressing manually the flexible material to the skin, it is at least partly compressed, and when releasing from the skin, the flexible material substantially returns to a starting shape, such as in the case of a sponge.

Hence, in specific embodiments the porous flexible material comprises a sponge, wherein the sponge comprises one or more of a natural sponge and a synthetic sponge. In yet further embodiments, the porous flexible material comprises one or more of polyether (PE), polyvinyl alcohol (PVA), polyester, poly urethane (PU), and cellulose. Cellulose based sponges are especially natural sponges. The other materials listed may be comprised by the synthetic sponges. Good results may be obtainable with polyvinyl alcohol (PVA), polyester, poly urethane (PU), especially with PU. In embodiments, the porous flexible material comprises a foam, such as a PU foam. In other embodiments, the porous flexible material comprises a PVA foam. Especially, the foams are (synthetic) sponges.

The regions may be configured in a plurality of possible configurations. As indicated above, best results appear obtainable when there are a limited number of first regions and a limited number of second regions, such as 1-6 first regions, especially 1-3 first regions, and 1-6 second regions, especially 1-3 second regions.

In embodiments, the first region circumferentially surrounds the second region. These embodiments appeared to provide good cleansing results and were appreciated highly by a test panel.

The bristles extend from the first region (of the treatment head surface). The porous flexible material extends from the second region (of the treatment head surface). Especially, the first region occupies a first area size (A1) of the treatment head (surface area) and the second region occupies a second area size (A2) of the treatment head (surface area), wherein the first region and the second region have an area size ratio of the first area size to the second area size $0.1 \leq A1/A2 \leq 100$, such as $0.2 \leq A1/A2 \leq 10$, like $0.2 \leq A1/A2 \leq 5$. Larger differences may reduce the efficiency of cleansing. Even more especially, the first region and the second region have an area size ratio of the first area size to the second area size $0.3 \leq A1/A2 \leq 0.9$. When a plurality of first regions and/or a plurality of second regions are applied, the area sizes are the cumulative area sizes of all first regions and/or second regions, respectively.

In yet further embodiments, wherein the bristles have a bristle height (h1) relative to said treatment head surface and the porous flexible material has a sponge height (h2) relative to said treatment head surface, wherein the bristles and the porous flexible material have a height ratio of the bristle height to the sponge height $0.5 \leq h1/h2 \leq 2$. Even more especially, the bristles and the porous flexible material have a height ratio of the bristle height to the sponge height $0.5 \leq h1/h2 \leq 1.5$. In embodiments, the porous flexible material may have a larger height than adjacent bristles. In yet other embodiments, the porous flexible material may have a smaller height than adjacent bristles. The term "adjacent bristles" refers to the bristles configured closest to the porous flexible material.

As indicated above, there may be more than one first region. In specific embodiments, the body care device, more especially the treatment head, comprises two or more first regions, wherein especially a first first region and a second first region have bristles having different bristle heights (h1). Other differences between the first regions may be selected from thickness of the bristles or material of the bristles. Varying height, thickness, material, etc. may provide additional properties to the treatment head, such as allowing pretreatment with radially more distant bristles and a treatment with radially less distant bristles. In specific embodiments, the bristles of the first first region have a bristle height (h11), the bristles of the second first region have a bristle height (h12), and $h11 < h12$, especially wherein $h11 < h12 < h2$. However, other embodiments may also be possible, such as $h11 > h12$, etc. In yet other embodiments, the bristles may have substantially equal heights and differ in thickness of material.

In specific embodiments, the first first region circumferentially surrounds the second first region, and the second first region circumferentially surrounds the second region. Such treatment head provided relative good results with a test panel in terms of user friendliness and cleansing results.

Of course, there can be more than two first regions. There can be a plurality of first regions. Within the first region(s) the height of the bristles may differ. Especially, there may be gradual decrease or increase in height from the center (of the treatment head (surface)) to the edge of the treatment head.

In yet further embodiments, the porous flexible material may include an active ingredient, such as a cosmetic material, a skin care material, and a pharmaceutical material. For instance, the porous flexible material may be impregnated with such active ingredient. The active ingredient may e.g. include charcoal. Good results are obtained with charcoal from the Poales order of plants, such as Poaceae. The Poales are an order of flowering plants in the monocotyledons, and includes families of plants such as the grasses (Poaceae), bromeliads, and sedges.

In yet a further aspect, the invention also provides the treatment head per se. Hence, the invention provides amongst others a treatment head, especially for use with the body care device as described herein, wherein the skin treatment head comprises a first region comprising a plurality of bristles and a second region comprising a porous flexible material. Further, the above (and below) described embodiments of the treatment head in relation to the body care device also apply to the treatment head per se.

In yet another aspect, the invention also provides a kit of parts comprising the body care device, with a detachable treatment head, especially a plurality of treatment heads, such as a plurality of different treatment heads.

The invention also provides a kit of parts comprising a plurality of treatment heads, especially a plurality of treatment heads including at least two different treatments heads.

In a specific embodiment, the kit(s) of parts comprises a treatment head wherein the porous flexible material comprises PVA, especially a PVA foam, and a treatment head wherein the porous flexible material comprises PU, especially a PU foam. Especially, the foams are synthetic sponges.

In embodiments, the porous flexible material comprising PVA is impregnated with an active ingredient, especially charcoal.

In yet a further aspect, the invention also provides a method of treating a part of a skin using the body care device as described herein, the method comprising providing a soap, or another liquid, to one or more of the part of the skin (to be treated) and the skin treatment head (especially the porous flexible material), applying the skin treatment head to the part of the skin, rotating (including optionally oscillating) the skin treatment head, and optionally moving the skin treatment head over the part of the skin. The liquid applied may especially comprise soap. Alternatively or additionally, the liquid may comprise another liquid. The liquid may also be only water, or water with an active ingredient. The term "soap" especially refers to a liquid soap or a liquid comprising a soap, such as used for cleansing (cleansing soap). In yet other embodiments, the term "soap" may also refer to a crème. Especially, the term "soap" refers to a liquid soap or a liquid comprising a soap. The term "soap" may also refer to a plurality of different soaps.

Further specific, but non-limiting embodiments are described below.

The device, for treating the skin, may comprise a housing, a shaft located in the housing having a longitudinal axis and an end for receiving a skin treating part, and a drive means configured to cause the shaft to rotate about its longitudinal axis, and optionally also to vibrate in a direction along the longitudinal axis, wherein the drive means comprise a rotational drive unit for rotating the shaft and an vibration generator for vibrating the shaft, the vibration generator is located about the shaft such that the shaft is rotatable relative to the vibration generator, the vibration generator comprises a solenoid and a flux assembly, and the flux assembly is moveable along the shaft relative to the solenoid.

This arrangement provides the advantage that in use, when a skin treating part is attached to the end of the shaft, the skin treating part moves substantially perpendicular to the skin which improves the cleaning and the massaging effect on the skin. Furthermore, the vibration generator is not coupled to the rotational drive unit and so the vibrating movement can be controlled independently to the rotation of the shaft.

Especially, the rotational drive unit and the vibrating generator are configured such that the speed of the rotation and the frequency of the vibration of the shaft can be independently changed of one another in response to a user input.

Advantageously, the user can therefore adjust the frequency and the speed of rotation to their personal preference. Especially, the flux assembly comprises an inner and an outer flux concentrator and a magnet located there between. The arrangement of the flux assembly concentrates the magnetic forces emitted by the magnet.

In embodiments, the outer flux concentrator is made of a base panel having a peripheral side panel, and the inner flux concentrator is received within the peripheral side panel, the magnet is located between the inner flux concentrator and the base panel, and a gap is formed between the inner flux concentrator and the peripheral side panel for receiving the solenoid.

Conveniently, the device further comprises first and second supports holding the shaft, the flux assembly being located about the shaft between the first and second supports and the solenoid being attached to one of the supports.

Advantageously, the flux assembly is retained between the first and second supports such that it cannot accidentally fall off the shaft.

Conveniently, the shaft is held by the first and second supports such that the shaft is rotatable relative to the supports about the longitudinal axis but prevented from moving along the longitudinal axis relative to at least one of the supports.

This arrangement enables the axial movement of the flux assembly to be transferred to the shaft as the flux assembly impacts at least one of the supports The shaft may comprise a circumferential groove in which the one of the supports locate so as to prevent the shaft from moving along the longitudinal axis relative to the support which located in the groove.

Advantageously, as the flux assembly impacts the support located in the groove, the support is moved in an axial direction and transfers the axial movement to the shaft.

One of the supports may be formed with an e-clip that locates in the circumferential groove.

This provides the advantage that the axial movement of the flux assembly is transferred to the support formed with an e-clip and as the e-clip locates in the groove the axial movement is transferred to the shaft.

Especially, one of the supports is formed with a stop which the flux assembly impacts as it vibrates. As the stop takes the impact of the flux assembly, wear of the support formed with the stop is advantageously reduced.

In one embodiment, a spring is located between the first and the second support and the flux assembly so as to reduce the impact as the flux assembly vibrates.

This arrangement advantageously reduces audible noise produced as the flux assembly impacts the first or second support.

The device further comprises a power source powering the drive means. Advantageously, this arrangement enables a single power source to power the drive means reducing size and weight of the device.

In one embodiment, the device further comprises an inverter for changing the current supplied by the power source to alternating current. This causes the polarity of the solenoid to change so that it alternates between being attracted and repelled to the magnet.

Conveniently, the device may comprise a frequency converter for changing the frequency of the alternating current.

Advantageously, the frequency converter is configured to change the frequency in response to a user input such that the strength of the vibrating movement of the shaft and so the tuft can be changed to the personal preference of a user.

The above embodiments describe options to introduce a vibratory movement, when desired. However, also options may be chosen to introduce a vibratory movement parallel to the rotation axis; the invention is not limited to these specific embodiments described above.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1:
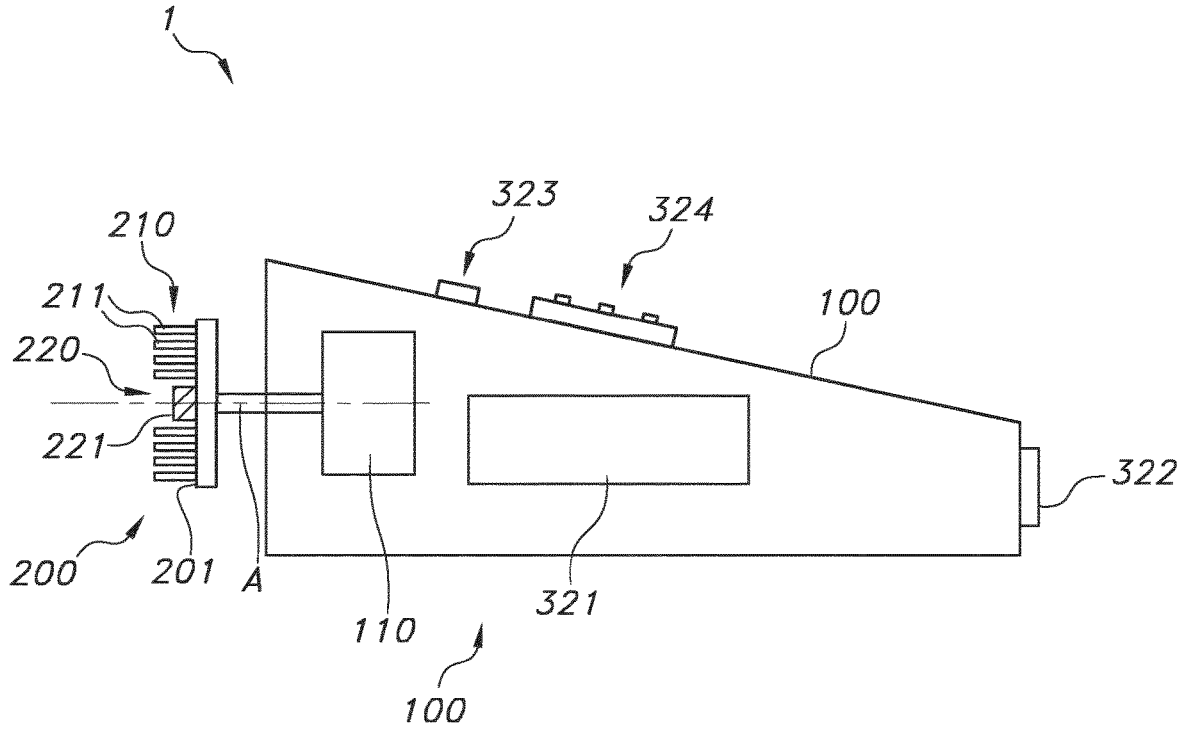
FIG. 1 schematically depicts an embodiment of the body care device.

FIG. 1 schematically depicts an embodiment of the device, indicated with reference 1, especially for use in cleansing the skin, such as the skin of a face. Here, the device, especially for treating the skin, comprises a housing 100 and a skin treatment head 200 rotatably associated with said housing 100. The housing 100 encloses an actuator 110 configured to rotate said skin treatment head 200. Further, the housing includes in this embodiment a rechargeable battery 321. Yet further, the housing 100 may comprise one or more LED indicators 323 and a user interface 324. Further, the housing may include a means 322 for receiving electrical power for charging the battery, such as a socket known in the art.

The skin treatment head 200 comprises bristles 211 associated with the treatment head 200. The bristles 211 may be configured in tufts, see also below.

The actuator 110 is especially configured to rotate the skin treatment head 200 about an axis A (axis of rotation). This axis may be parallel, but is not necessary parallel to a body axis of the device. The skin treatment head 200 comprises a first region 210 comprising a plurality of bristles 211. The skin treatment head 200 also comprises a second region 220 comprising a porous flexible material 221. The porous flexible material 221 may comprises a sponge 222, such as a natural sponge or a synthetic sponge.

Reference 201 indicates a treatment head surface. The bristles 211 extend from this surface.

Figure 2A:
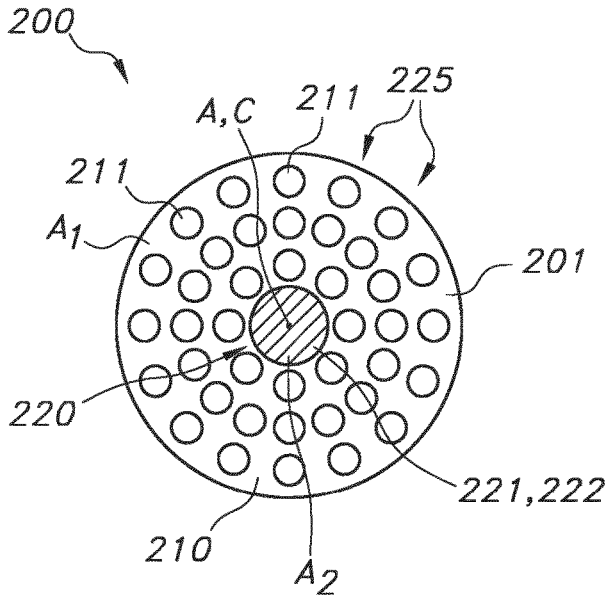
FIGS. 2*a*-2*f* schematically depicts some embodiments and variants of the treatment head.

FIG. 2*a* schematically depicts an embodiment of the treatment head 200, in top view, wherein the first region 210 circumferentially surrounds the second region 220. Of course, other configurations are also possible. Here, the indication of the axis A coincides with the center, indicated with C, of the treatment head 200.

In general, the treatment head 200 will have a circular cross-section.

Figure 2B:
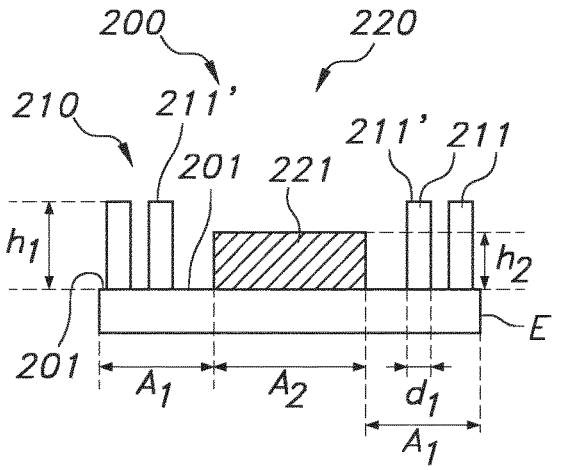

FIG. 2*b* schematically depicts an embodiment of the treatment head 200 in cross-sectional view. The first region 210 occupies a first area size A1 of the treatment head 200 and the second region 220 occupies a second area size A2. In variants, the first region 210 and the second region 220 have an area size ratio of the first area size to the second area size $0.1 \leq A1/A2 \leq 100$, such as $0.2 \leq A1/A2 \leq 10$, like especially $0.2 \leq A1/A2 \leq 5$.

Further, the bristles 211 have a bristle height hl relative to the treatment head surface 201. The porous flexible material 221 has a sponge height h2 relative to said treatment head surface 201. In variants, the bristles 211 and the porous flexible material 221 have a height ratio of the bristle height to the sponge height $0.5 \leq h1/h2 \leq 2$.

The porous flexible material 221 may have a larger height h2 than the height h1 of adjacent bristles, indicated with reference 211' (which are bristles configured closest to the porous flexible material). In yet other embodiments, the porous flexible material 221 may have a smaller height h2 than the height h1 of adjacent bristles 211' (as schematically indicated in FIG. 2*b*). The edge of the treatment head 200 is indicated with reference E.

Figure 2C:
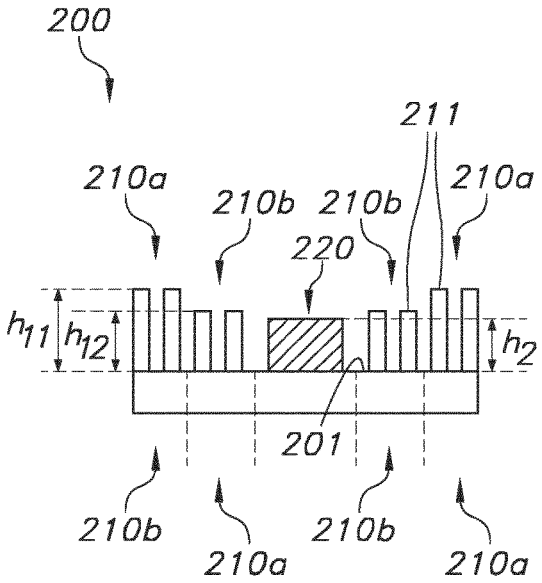

FIG. 2*c* schematically depicts in a cross-sectional view an embodiment of the treatment head 200 comprising two or more first regions 210, wherein a first first region 210*a* and a second first region 210*b* have bristles 211 having different bristle heights h1. The first first region 210*a* includes bristles having a bristle height h11. The bristles 211 of the second first region 210*b* have a bristle height h12. In variants, $h11 < h12$; in other variants, as schematically depicted here, $h11 < h12$. In further variants, $h11 < h12 < h2$. In other variants, as schematically depicted here, $h11 < h12 < h2$.

Figure 2D:
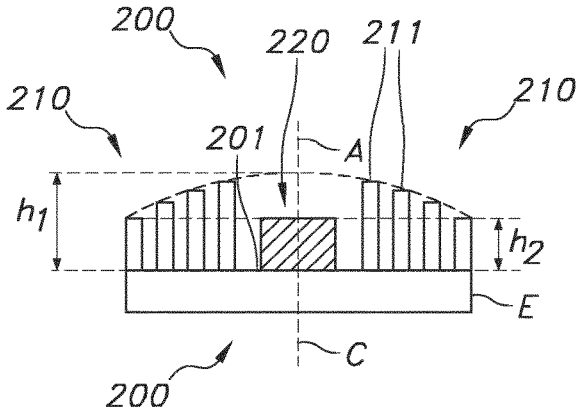

More than two first regions may be available. FIG. 2*d* schematically depicts an embodiment with the heights varying from the center to the edge.

The area A1 of the first region is especially the sum of the areas occupied by all bristles 211, irrespective of their specific first regions. The treatment head 200 including the bristles 211 may also be indicated as "brush".

FIG. 2*d* schematically depicts an embodiment wherein the treatment head 200 has curved treatment head surface 201. In the schematically depicted embodiment of FIG. 2*d*, the bristles 211 are configured to provide a curved brush.

Embodiments described herein may especially include a centrosymmetrical arrangement of the first region 210 and the second region 220, see e.g. FIG. 2*a*, but also FIGS. 1, 2*b*, 2*c* may refer to such embodiments. Would FIG. 2*d* schematically depict a treatment head 200 having a centrosymmetrical configuration, then the treatment head surface 201 may be curved in two directions. In FIGS. 2*c* radially more distant bristles have a larger height (than radially less distant bristles), whereas in FIG. 2*d* radially more distant bristles have a smaller height (than radially less distant bristles). The bristles 211 closest to the edge E are configured radially most distant (from the center C).

Figure 2E:
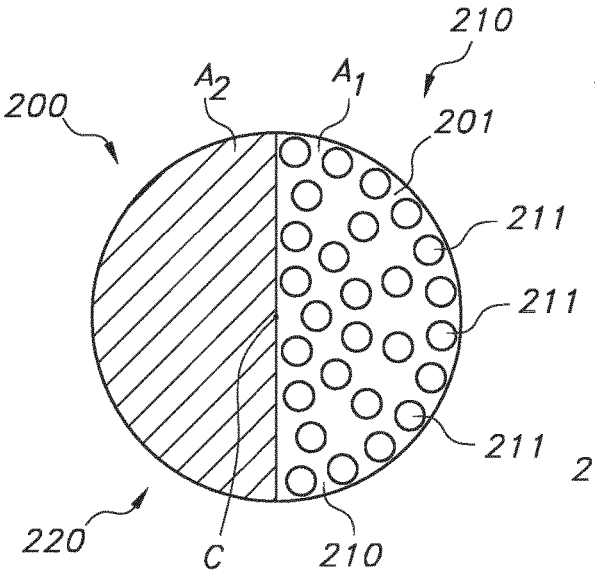

FIG. 2*e*, however, schematically depicts an embodiment of a non-centrosymmetrical configuration of the first region 210 and the second region 220. Of course, other configurations may also be possible.

Figure 2F:
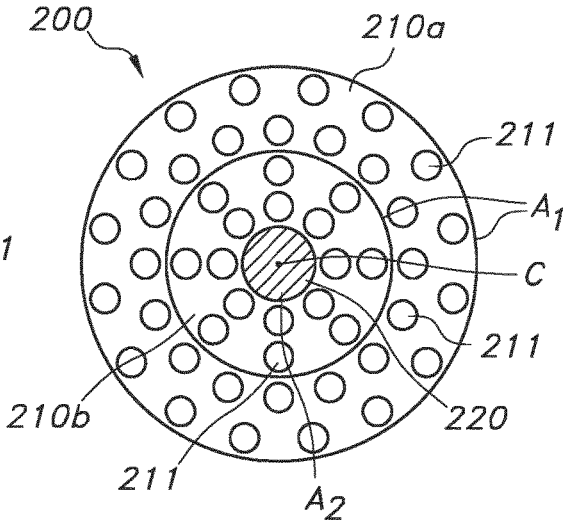

FIG. 2*f* schematically depicts a top view of a variant as schematically depicted in FIG. 2*c*.

The term "substantially" herein, such as in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A body care device for treating a skin, the body care device comprising:

a housing comprising:

an actuator; and a skin treatment head associated with the housing, said skin treatment head comprising:

a first region comprising a plurality of bristles; and a second region comprising a porous flexible material, wherein said plurality of bristles within said first region have a height (h1) extending from said skin treatment head closest to said second region being greater than a height (h2) of said porous flexible material, wherein said height (h1) of said plurality of bristles decreases to said height h2 as said plurality of bristles extend toward an edge of said treatment head, said plurality of bristles configured to:

provide a pretreatment of said skin by contacting said skin prior to said porous flexible material contacting said skin; and flex away from the second region, while contacting said skin, as a pressure applied to said skin treatment head is increased to enable said porous flexible material of said second region to contact said skin, wherein said actuator is configured to:

partly rotate the skin treatment head about an axis (A).

2. The body care device according to claim 1, wherein the porous flexible material comprises a sponge, said sponge comprising one or more of a natural sponge and a synthetic sponge.

3. The body care device according to claim 1, wherein the first region circumferentially surrounds the second region.

4. The body care device according to claim 1, wherein the first region occupies a first area size (A1) of the treatment head, the second region occupies a second area size (A2), and the first region and the second region have an area size ratio of the first area size to the second area size $0.1 \leq A1/A2 \leq 100$.

5. The body care device according to claim 1, wherein the height (h1) of said bristles from said treatment head and the height (h2) of said porous flexible material from said treatment head having a height ratio in a range of $1.0 < h1/h2 \leq 2$.

6. The body care device according to claim 1, wherein the first region and the second region have a ratio of a first area size (A1) of the first region to a second area size (A2) of the second region of $0.2 \leq A1/A2 \leq 5$, and a height ratio of the bristle height (h1) to the porous flexible material height (h2) is in a range of $1.0 < h1/h2 \leq 1.5$, and wherein the porous flexible material is impregnated with charcoal.

7. The body care device according to claim 1, wherein the bristle height (h1) relative to said treatment head is in a range of 4-30 mm, and wherein the bristles have a bristle thickness (d1) in a range of 20-300 μm, and the bristles comprise a polyamide.

8. The body care device according to claim 1, wherein the porous flexible material has a density selected from the range of 2-100 $kg/m^3$, the porous flexible material has a compression strength at 40% at a pressure in the range of 1-15 kPa, and the porous flexible material comprises one or more of polyether (PE), polyvinyl alcohol (PVA), polyester, poly urethane (PU), and cellulose.

9. The body care device according to claim 1, wherein the porous flexible material comprise a polyvinyl alcohol (PVA) sponge or a poly urethane (PU) sponge.

10. The body care device according to claim 1, wherein said first region comprises:

a first first region; and a second first region, wherein said bristles of the first region within said first first region have a bristle height (h11) and said bristles of the first region within said second first region have a bristle height (h12), wherein $h11 < h12$.

11. The body care device according to claim 10, wherein the first first region circumferentially surrounds the second first region, and wherein the second first region circumferentially surrounds the second region.

12. The body care device according to claim 1, wherein the actuator is further configured to vibrate the skin treatment head parallel to the axis (A).

13. The body care device according to claim 1, wherein the skin treatment head is detachable associated to the housing.

14. A method of treating a part of a skin using a body care device comprising:

a housing; and a skin treatment head associated with the housing, said skin treatment head comprising:

a first region comprising a plurality of bristles extending a height h1 from said skin treatment head, wherein said height of said plurality of bristles decreases to a height h2 as said plurality of bristles extend toward an edge of said skin treatment head; and a second region comprising a porous flexible material extending said height h2 from said skin treatment head, h1 being greater than h2, wherein said bristles within said first region provide a pretreatment of said skin and are configured to flex away from the skin to enable said porous flexible material of said second region to contact said skin, the method comprising:

providing a soap to one or more of said part of said skin and said skin treatment head;

applying the skin treatment head to the part of the skin using a first pressure to enable the plurality of bristles to contact said skin;

applying a second pressure to said skin treatment head to allow said porous flexible material to contact said skin, said second pressure being greater than said first pressure; and rotating the skin treatment head as said skin treatment head is applied to said skin using one of: said first pressure and said second pressure.

15. The method of claim 14, further comprising:

moving the skin treatment head over corresponding ones of the one or more parts of the skin.

16. A treatment device for treatment of a user's skin comprising:

a skin treatment head comprising:

a first region comprising a plurality of bristles extending from said skin treatment head a height h1, wherein said height of said plurality of bristles decreases to a height h2 as said plurality of bristles extend toward an edge of said skin treatment head; and a second region, positioned within said first region, comprising a skin treatment element extending from said skin treatment head said height, h2, wherein said height, h1 of said plurality of bristles within said first region closest to said second region is greater than said height, h2; and an actuator removably attached to the skin treatment head, wherein said actuator is configured to rotate the skin treatment head.

17. The treatment device of claim 16, wherein said skin treatment element within said second region is one of: a plurality of bristles and a porous material.

18. The treatment device of claim 16, wherein said first region and said second region are concentric, with the first region surrounding the second region.

19. The treatment device of claim 16, wherein the first region is positioned adjacent the second region.

* * * * *